US008048271B2

(12) United States Patent
Andersson

(10) Patent No.: US 8,048,271 B2
(45) Date of Patent: Nov. 1, 2011

(54) ARRANGEMENT FOR WASHING AND DEWATERING CELLULOSE PULP

(75) Inventor: Rickard Andersson, Matfors (SE)

(73) Assignee: Metso Paper, Inc. (FI)

( * ) Notice: Subject to any disclaimer, the term of this patent is extended or adjusted under 35 U.S.C. 154(b) by 190 days.

(21) Appl. No.: 12/600,926

(22) PCT Filed: May 21, 2008

(86) PCT No.: PCT/SE2008/050597

§ 371 (c)(1),
(2), (4) Date: Nov. 19, 2009

(87) PCT Pub. No.: WO2008/147311

PCT Pub. Date: Dec. 4, 2008

(65) Prior Publication Data

US 2010/0155007 A1 Jun. 24, 2010

(30) Foreign Application Priority Data

May 25, 2007 (SE) ..... 0701269

(51) Int. Cl.
*D21F 1/00* (2006.01)

(52) U.S. Cl. ..... 162/232

(58) Field of Classification Search ..... 162/232, 162/302, 252, 303, 258, 323, 263; 100/121, 100/156

See application file for complete search history.

(56) References Cited

U.S. PATENT DOCUMENTS 3,980,518 A 9/1976 Ljung et al.
5,589,035 A 12/1996 Sundqvist

FOREIGN PATENT DOCUMENTS

FI 102977 A 7/1996

OTHER PUBLICATIONS

International Search Report, PCT/SE2008/050597, dated Aug. 27, 2008.

*Primary Examiner* — Mark Halpern
(74) *Attorney, Agent, or Firm* — Lerner, David, Littenberg, Krumholz & Mentlik, LLP

(57) ABSTRACT

Apparatus for washing and dewatering cellulose pulp is disclosed comprising: a rotatable press roll having a perforated outer surface for dewatering the pulp; a stationary guide surface arranged at a distance from the perforated outer surface so as to enclose the press roll in the circumferential direction, such that a substantially closed vat is defined between stationary guide surface and the press roll; a pulp passage, being provided between the perforated outer surface and its stationary guide surface, such that during operation, pulp is transported in the direction of rotation and, at the end of the pulp passage, is pressed in a pinch between the press roll and a second press roll. A radial distance between the stationary guide surface and the associated press roll is generally increasing towards the pinch, such that the vat diverges, towards the pinch.

11 Claims, 5 Drawing Sheets

ARRANGEMENT FOR WASHING AND DEWATERING CELLULOSE PULP

CROSS-REFERENCE TO RELATED APPLICATIONS

The present application is a national phase entry under 35 U.S.C. §371 of International Application No. PCT/SE2008/050597, filed on May 21, 2008, published in English, which claims priority from Swedish Patent Application No. 0701269-3 filed on May 25, 2007, all of which are incorporated herein by reference.

FIELD OF THE INVENTION

The present invention relates to washing and dewatering of cellulose pulp and in particular to a wash/dewatering apparatus with one, or preferably two co-operating, cylindrical press rolls.

BACKGROUND OF THE INVENTION

Pulp washing is a key operation in the chemical pulping line. There are many different types of washing and dewatering apparatuses available, some of which are based on washing by pressing the pulp such that fluid is removed.

A well-known type of wash press has two co-operating cylindrical press rolls, arranged with their center of rotation in the same horizontal plane. The outer surface of each press roll is perforated and, during operation, cellulose pulp is input to a restricted space between the perforated roll surface and a restriction member, such as a vat, whereby a pulp web is formed on the perforated roll surface. The press rolls are arranged to rotate in opposite directions so as to transport the respective pulp webs in the direction of rotation to be pressed in a so-called pinch or nip where the distance between the press rolls is smallest.

The fluid removed from the pulp (i.e. the filtrate) passes through the perforated roll surface in a radially inward direction and can for example be transported to the ends of the respective press rolls by means of axial filtrate channels. There is normally a filtrate tank arranged in connection with the wash press to collect all filtrate resulting from the washing in the press. There is often a supply of washing liquid to the wash press, and since the washing liquid displaces fluid in the pulp, the washing principle will in such a case be a combination of dewatering, displacement and pressing.

A wash press of the described general type is disclosed in U.S. Pat. No. 3,980,518, for example.

Another example of a wash press of the above-described general type is the wash press disclosed in EP 1 035 250. The objective of this wash press is to improve the total dewatering and this particular wash press has a vat design in which the vat is converging towards the outer surface of the press roll, in the direction of rotation of the press roll. The vat is arranged to enclose the outer surface of the press roll from a pulp inflow chamber placed in the region of the press roll's highest point and further around at least 230° of the outer surface's circumference, so that the pulp web formed is constrained to run between the outer surface and the vat around at least 230° of the circumference while being subjected to a converging vat, before the fibrous web reaches the final pinch between the press rolls.

A problem associated with a wash press with a long converging enclosed area is the tendency of plugging of the pulp suspension in the confined area between the vat and the outer surface of the press roll. Plugging of pulp suspension leads to undesired stops in the operation of the wash press with time-consuming cleaning operations and loss of production as a result. Another problem associated with such a wash press is that the pressure profile associated with the converging space leads to a rather tough treatment of the pulp suspension confined in the space between the outer surface of the press roll and the surrounding vat. The pressure created by the converging geometry forces not only fluid from the fiber suspension, but also fibers, through the perforations of the outer surface of the press roll. This leads to losses of valuable fibers, which results in lower production of pulp coming out of the washing/dewatering operation. Moreover, fibers in the filtrate complicate the handling of the filtrate and may demand external equipment in order to recover the fibers from the filtrate. This is especially the case if the filtrate is to be purged to external treatment or to a recipient. Yet another problem with wash presses with converging vat profiles is the build up of friction forces acting on the vat structure, which calls for a strong load supporting structure for the vat structure, inducing increased costs for the load supporting structure.

Accordingly, there is a need for a wash press reducing the problems associated with a wash press of the kind described above.

One of the objects of the present invention is to provide an improved arrangement for washing cellulose pulp. A specific object is to achieve improved runnability of a wash press with cylindrical press rolls where a rather large part of the circumference of the press rolls is enclosed by a vat. Another object of the present invention is to reduce the fiber content in the output flow of filtrate from the wash press.

Still other objects of the present invention are to enable wash presses in which the fiber suspension being treated is subjected to more lenient conditions, implicating less damage to the fibers in the suspension and to enable wash presses which are less sensitive to variations in terms of for example concentration and flow of the pulp suspension fed into the wash press.

SUMMARY OF THE INVENTION

In accordance with the present invention, these and other objects have now been realized by the invention of apparatus for washing and dewatering cellulose pulp comprising a first rotatable press roll for use in conjunction with a second rotatable press roll forming a pinch therebetween for dewatering the cellulose pulp, the first rotatable press roll including a first perforated outer surface for dewatering the cellulose pulp, a first inlet disposed adjacent to the first rotatable press roll for supplying the cellulose pulp to the first perforated outer surface, and a first stationary guide member circumferentially enclosing the first rotatable press roll from the first inlet to the pinch and forming a substantially closed vat thereby forming a first pulp passage having a predetermined radial dimension between the first perforated outer surface of the first rotatable press roll and the first stationary guide surface, whereby the cellulose pulp is transported through the first pulp passage as the first rotatable press roll rotates towards the pinch, the predetermined radial dimension increasing over the distance from the first inlet to the pinch whereby the substantially closed vat diverges from the first rotatable press roll, and the first stationary guide surface being substantially free of any perforations for the passage of liquid therethrough in the area of the pinch thereby maintaining the pressure in the area of the pinch. In a preferred embodiment, the first stationary guide surface is substantially free of any perforations substantially over its entire surface from the first inlet to the pinch. In another embodiment, the apparatus includes a second rotatable press roll juxtaposed with the first rotatable press roll thereby forming the pinch therebetween, the second rotatable press roll including a second perforated outer surface for dewatering the cellulose pulp, a second inlet disposed adjacent to the second rotatable press roll for supplying the cellulose pulp to the second perforated outer surface, and a second stationary guide member circumferentially enclosing the second rotatable press roll from the second inlet to the pinch forming a substantially closed vat thereby forming a second pulp passage having a predetermined radial dimension between the second perforated outer surface of the second rotatable press roll and the second stationary guide surface, whereby the cellulose pulp is transported through the second pulp passage as the second rotatable press roll rotates towards the pinch, the predetermined radial dimension increasing over the distance from the second inlet to the pinch, whereby the substantially closed vat diverges from the second rotatable press roll, and the second stationary guide surface being substantially free of any perforations for the passage of liquid therethrough in the area of the pinch thereby maintaining the pressure in the area of the pinch whereby a wedge volume is formed in the area of the pinch into which the cellulose pulp is fed from the first and second pulp passages before they merge and enter into the pinch.

In accordance with one embodiment of the apparatus of the present invention, the apparatus includes at least one washing zone for adding liquid into the first pulp passage.

In accordance with another embodiment of the apparatus of the present invention, the predetermined radial dimension continues to increase over at least 80% of the first pulp passage.

In accordance with another embodiment of the apparatus of the present invention, the first stationary guide surface encloses the first press roll around at least about 160° of the circumference of the first press roll, preferably around at least about 180° of the circumference of the first press roll, and most preferably around at least about 225° of the circumference of the first press roll.

In accordance with another embodiment of the apparatus of the present invention, the first inlet is disposed proximate to the highest vertical point of the first press roll.

In accordance with another embodiment of the apparatus of the present invention, the predetermined radial dimension is from between 10 and 200 mm, and preferably from between 20 and 60 mm.

Briefly, the present invention is based on the recognition that the pressure profile created by a converging geometry is not needed to achieve the desired production capacity along with satisfactory washing and dewatering for a wash press where a major part of the roll circumference is enclosed by a vat. It was earlier believed that the pulp suspension had to be forced towards the outer surface of the press roll by a forcing geometry, e.g. a converging vat. However, in accordance with recent findings it has now been shown that the fiber suspension can be washed and dewatered in an efficient way by letting the fiber suspension be formed against the outer surface of the press roll in a more open geometry. The pressure in the confined space between the press roll and the vat is built up dependent on the drainage properties of the fiber suspension and the fiber suspension itself decides how and when it is to be dewatered. This also leads to a more lenient treatment of the fiber suspension with fewer fibers in the filtrate as a result. Runnability problems, e.g. due to plugging of the fiber suspension are avoided or reduced at the same time as high capacity and high washing efficiency is obtained. In this way, the negative effects associated with a wash press of the aforementioned kind is avoided or reduced.

Thus, in accordance with the present invention, there is provided apparatus for washing cellulose pulp is provided, which arrangement comprises: a press roll, which is arranged to rotate during operation and which has a perforated outer surface for dewatering the pulp; a stationary guide surface, arranged at a distance from the perforated outer surface of the press roll so as to enclose the press roll in the circumferential direction, such that a substantially closed vat is defined between stationary guide surface and the press roll; a pulp passage, being provided in said vat between the perforated outer surface of the press roll and its stationary guide surface, such that during operation, pulp that is fed into the vat is transported in a direction of rotation and, at the end of the pulp passage, is pressed in a pinch possibly between the press roll and a second press roll. Further, a radial distance between the stationary guide surface and the associated press roll is generally increasing towards the pinch, such that the vat diverges, towards the pinch.

The proposed washing arrangement leads to a number of advantages, including:

- Minimized risk of plugging
- Reduced fiber content in the filtrate
- Less sensitivity to variations in the incoming pulp in terms of concentration and flow.
- Better overall runnability properties, such as minimizing the need to quickly react to changed operation conditions in order to avoid plugging.

BRIEF DESCRIPTION OF THE DRAWINGS

The present invention, together with further objects and advantages thereof, is best understood from the following detailed description, with references to the appended drawings, of which.

DETAILED DESCRIPTION

Figure 1:
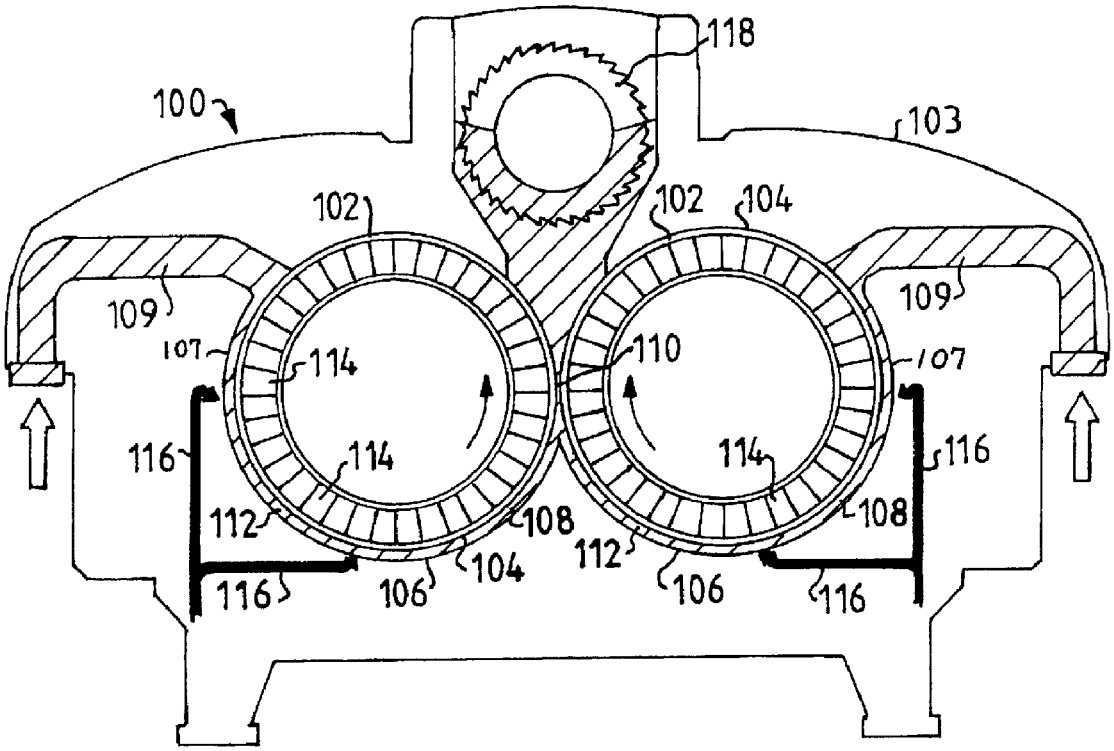
FIG. 1 is a side, elevational, schematic, transverse cross-sectional view of a washing arrangement in which the present invention may be used.

In the drawings, similar or corresponding elements are denoted by the same reference numbers.

FIG. 1 illustrates an exemplifying washing arrangement in which the present invention may be used. The washing arrangement 100 is of the general type described in the background section and comprises two co-operating cylindrical press rolls or drums 102 inside a casing 103. The two press rolls 102 are arranged to rotate in opposite directions during operation (as indicated by the arrows) and each has a perforated outer surface 104, such as a surface of perforated sheet metal. The washing arrangement 100 further presents guide surfaces 106, arranged at a distance from the perforated outer surface 104 of the respective press roll 102 so as to partially enclose the press roll in the circumferential direction, whereby a pulp passage 108 is defined between the perforated outer surface 104 and the guide surface 106. The guide surfaces 106 constitute a vat 107.

During operation, pulp fed from a pulp inlet 109 into a pulp passage 108 is guided by the guide surface 106 in the direction of rotation, and is pressed in a so-called pinch or nip 110 between the press rolls 102. In the illustrated example, pulp is input on the opposite sides with respect to the pinch 110 of the respective press roll 102. A pulp web 112 is thus formed on the perforated roll surface 104. Typically there is some form of distribution means (not illustrated in this figure) to distribute the pulp evenly along the length of the press roll 102. The press rolls 102 rotate in opposite directions so as to transport the respective pulp web 112 in the direction of rotation to be pressed in the pinch 110 where the distance between the press rolls 102 is smallest. In the circumferential direction, the pulp passage 108 extends from the position or area where pulp is introduced onto the outer surface 104 of the press roll 102 and to the pinch 110 between the press rolls. The illustrated press rolls 102 comprise axial filtrate channels 114 which receive the filtrate that passes through the perforated roll surface 104. Washing liquid is in this example supplied to the pulp web at two different points (lines 116) per press roll 102. Washing liquid could, if desired, be supplied at more points per press roll or only at one point. The term point should be understood to possibly involve a certain extension in the circumferential direction. Pulp is output by means of a screw arrangement 118 which transfers the pulp to a subsequent process stage (not shown), such as a standpipe or another unit where the pulp may be diluted and processed.

Figure 2:
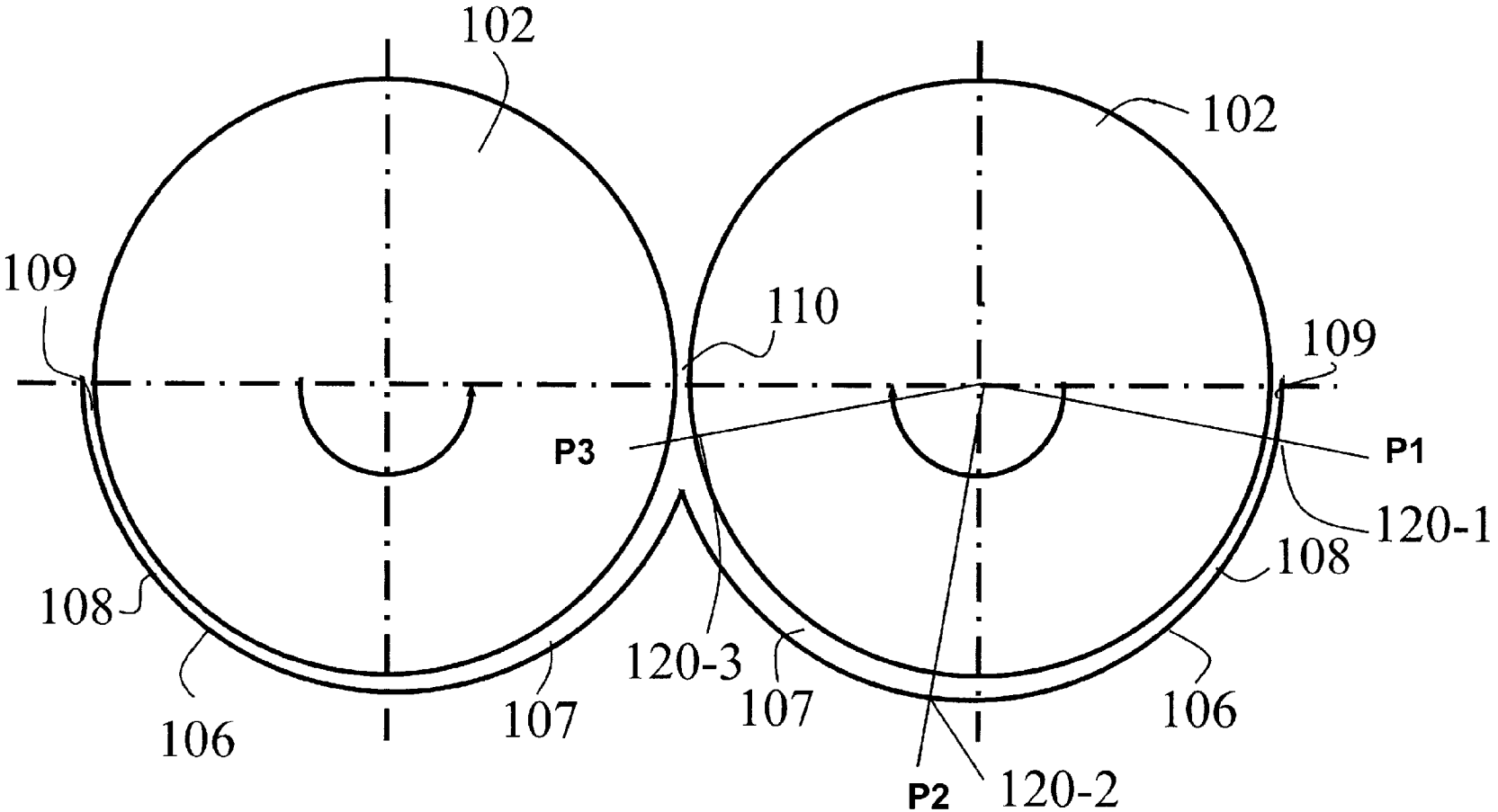
FIG. 2 is a side, elevational, schematic, transverse cross-sectional view illustrating pressure measurement positions in a washing arrangement according to the present invention.

FIG. 2 schematically illustrates the placement of pressure gauges (120) in a washing arrangement, such as the one in FIG. 1, for example, for measuring the pressure at different positions throughout the vat. A first pressure gauge 120-1 is placed in a first position P1 located approximately at a distance of 10° in the circumferential direction, the 0° position in connection with this figure being at the outermost point of the press roll 102, at the inlet 109. A second pressure gauge 120-2 is placed at a second position P2 located approximately at 100° and a third pressure gauge 120-3 placed at a third position P3 located at approximately 1700°, relatively close to the nip 110. The positions in this figure are meant to be illustrative examples with reference to the circumferential direction and the radial placement of the pressure gauges, and may of course be varied as desired by the skilled person.

It has long been believed that the vat is a completely communicating space. Thus, the vat pressure has only been measured at one point, which has then been taken as a measure of the vat pressure for the entire vat. The conventional position for measuring the vat pressure has been at the bottom of the vat, i.e. in the vicinity of the lowest point of the press roll. Recently, during measurements of the pressure at different points of the vat, it was surprisingly found, that the vat pressure is not at all constant throughout the vat, but increases towards the nip. The fact that the pressure increases through the vat 107 implies that the press rolls 102 drag the pulp forward in a direction towards the nip. This means that it is not the pump that feeds the press that pushes the pulp forward in the press. Instead, the pulp becomes attached to the rolls 102 due to the pressure difference over the pulp web, and the rolls 102 subsequently drag the pulp forward in a direction towards the nip 110. Therefore, the pressure close to the nip 110 seems to be mainly governed by the production rate, while the pressure close to the pulp inlet 109 seems to be more dependent of the flow rate of pulp fed to the wash press 100.

Figure 3:
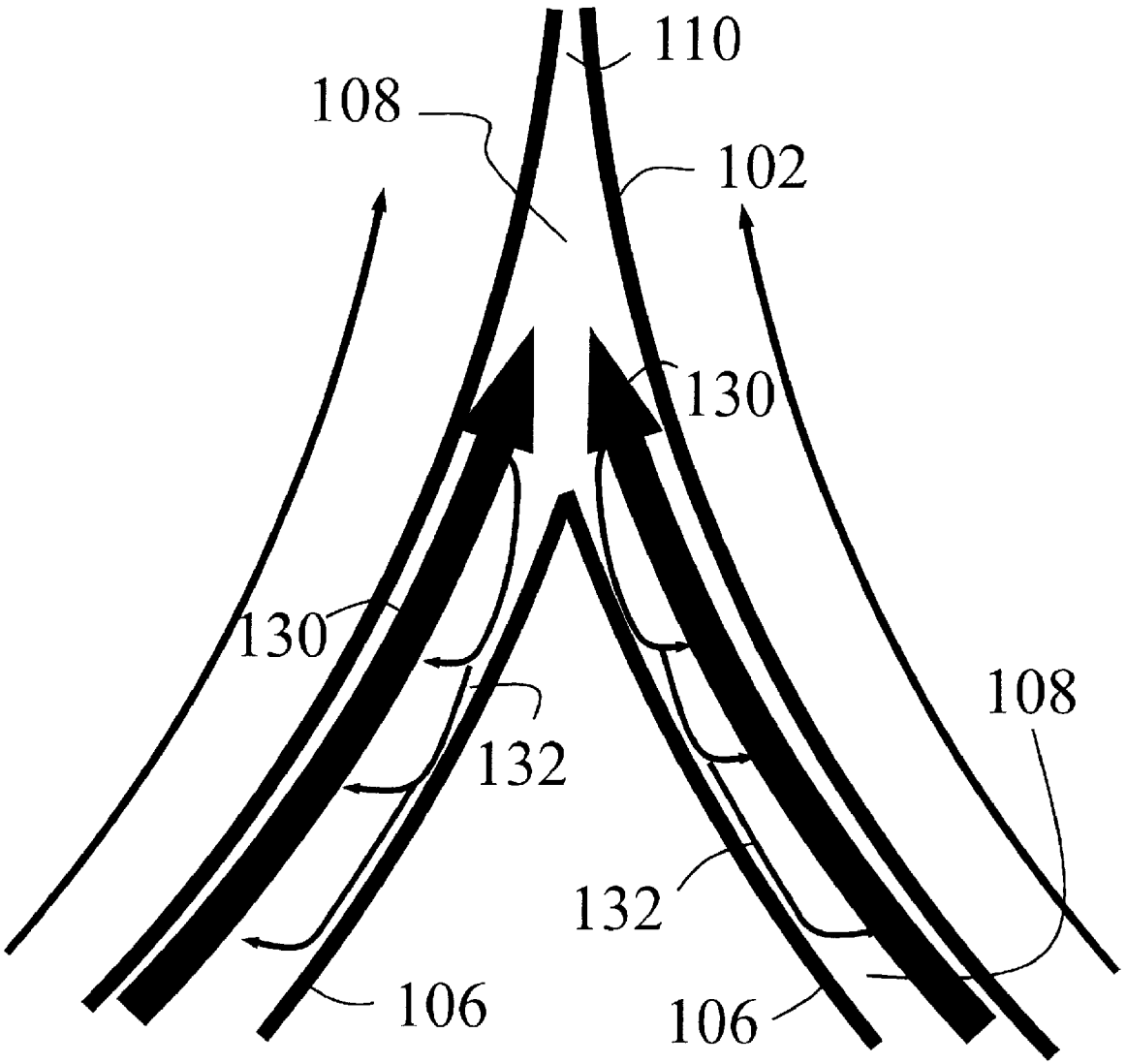
FIG. 3 is a side, partial, elevational, schematic view illustrating the principle of pulp flowing back from the nip between the two co-operating press rolls of the washing arrangements shown in FIGS. 1 and 2.

FIG. 3 schematically illustrates the principle of pulp suspension flowing back from the nip and countercurrent to the movement of the pulp web 112 in the pulp passage during the operation of the two co-operating press rolls 102 of a washing arrangement according to the present invention, such as the one in FIGS. 1 and 2. A main pulp flow 130, comprising the pulp web 112 attached to the press roll 102, is transported in the direction of rotation of the respective press rolls 102. The highest pressure is obtained in the nip. Due to the vat pressure being lower in the direction countercurrent to the rotation of the press rolls 102, there is also a driving force for pulp suspension to flow in a direction countercurrent to the main pulp flow 130. Since the vat of a wash press according to the present invention has diverging geometry instead of a converging geometry, which would imply a very small gap size close to the nip, there is room for such a partial flow of pulp suspension 132 in a countercurrent direction. The pulp suspension flowing in the countercurrent direction gives rise to a hydraulic pulse. It has surprisingly been found that this hydraulic pulse transmitted through the pulp web in the pulp passage introduce a considerable draining effect upon the pulp suspension in the pulp passage, and there is thus no need for any convergence of the pulp passage before the nip.

The partial flow of pulp suspension 132 does not necessarily have the same fiber concentration as the main flow 130. Typically, the partial flow 132 will be of a lower concentration compared to the main flow 130, but it is also possible to have a partial flow with a higher concentration than the main flow. The partial flows 132 are typically smaller than the respective main flows 130.

By merging the two flows of pulp 130 from the pulp passages 108 into a wedge-formed volume before the nip, and immediately after the final end of the stationary guide surfaces 106, a gradual convergence is created in the merged wedge-formed pulp volume before the merged pulp flows enters the actual nip. This convergence is thus only due to the actual nip and not to any convergence of the guide surfaces 106. From the nip, a pressure build up is generated hydraulically in the pulp webs counter current to the flow of pulp, which pressure build up improves the pulp draining.

Based on this understanding, the present invention suggests an arrangement which is adapted to utilize the pressure profile created by the pulp suspension itself when allowed to flow more freely.

Figure 4:
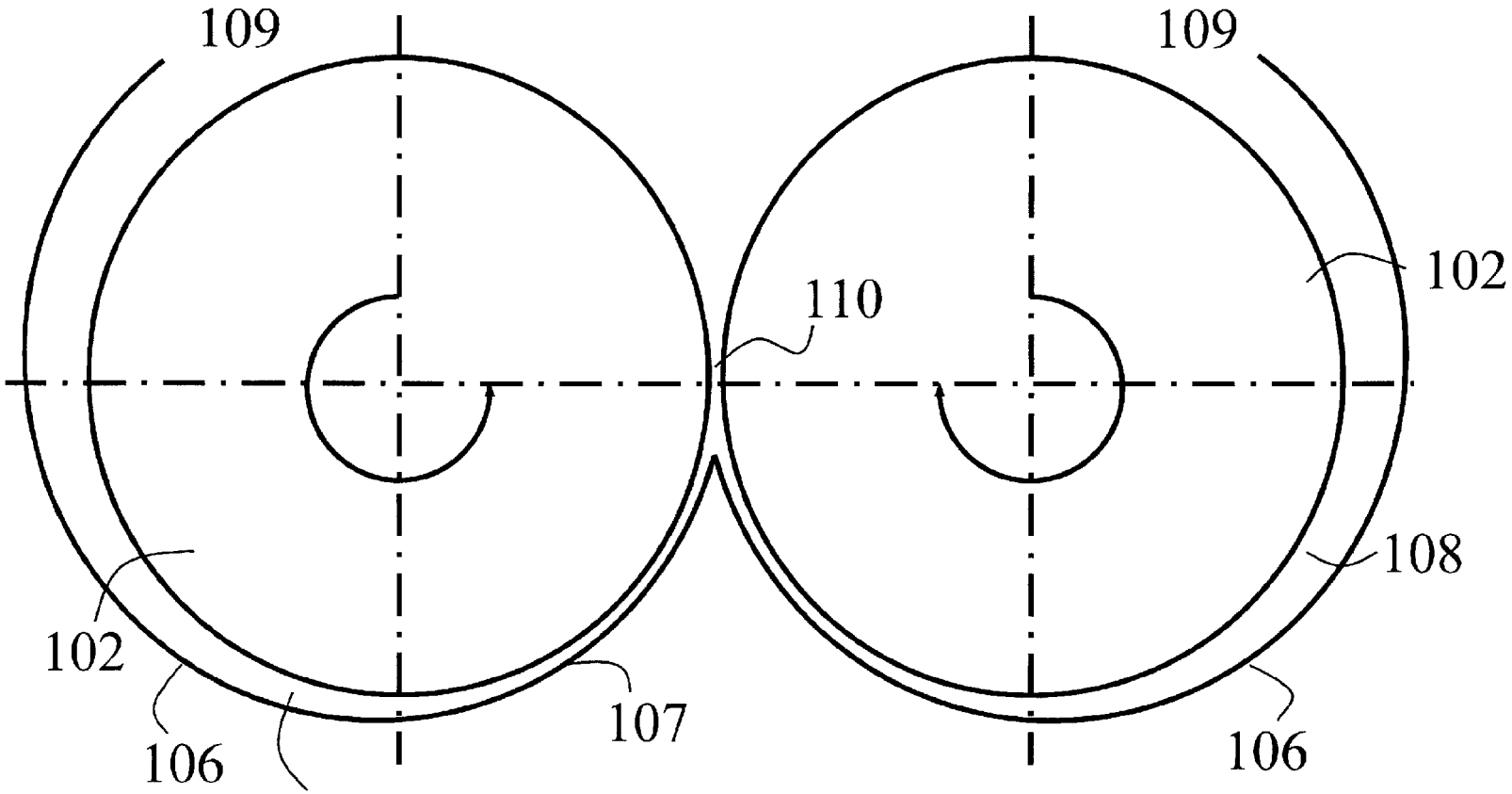
FIG.4 (prior art)
FIG. 4 is a side, elevational, schematic transverse cross-sectional view of a wash press with a converging space between a press roll and an enclosing guide surface of the prior art.

FIG. 4 (prior art) illustrates a conventional washing arrangement 100 with the pulp passage 108 converging towards the outer surface of the press roll 102 in a direction towards the nip 110.

Figure 5:
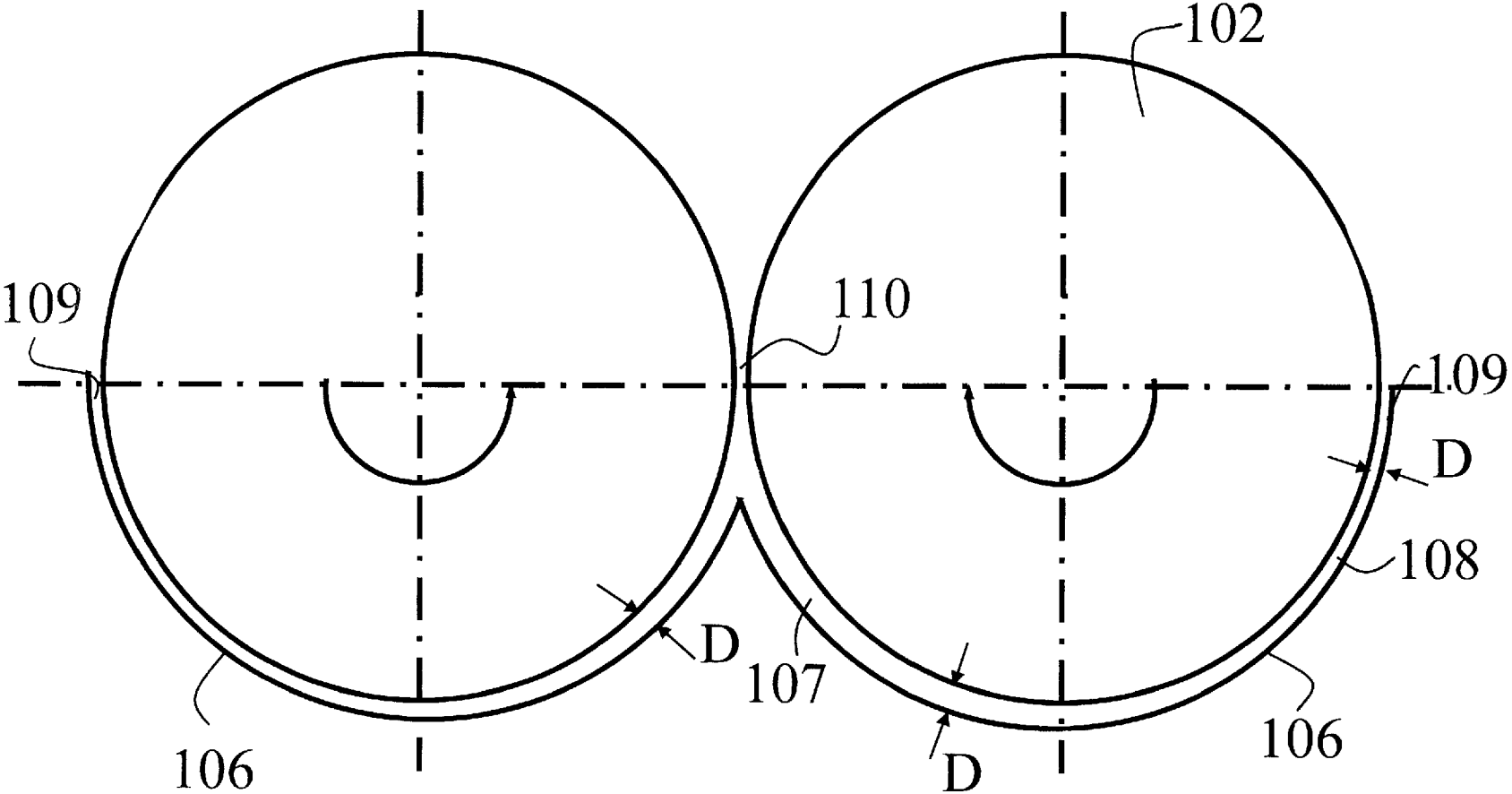
FIG. 5 is a side, elevational, schematic, transverse cross-sectional view of a wash press according to another embodiment of the present invention.

FIG. 5 illustrates a washing arrangement 100 according to the present invention, with a diverging pulp passage 108 along the vat circumference. The radial distance D from the press roll 102 to the guide surface 106 is generally increasing over a main portion of the pulp passage enclosed by the guide surface 106 in the circumferential direction, wherein a main portion is to be understood as comprising a major part of the vat 107 enclosing the press rolls 102. The term "generally" regarding the increasing radial distance D should in this context be understood to comprise embodiments where it at parts is kept constant, and at some parts, due to fluctuations or irregularities in the guide surfaces 106, even converges, but that the overall configuration of the guide surfaces 106 is such that pulp passage diverges towards the pinch 110.

Thus, the pulp passage 108 has an increasing gap size defined by the radial distance D. In other words the guide surface 106 is in a first embodiment continuously diverging from the outer surface of the press roll 102 throughout mainly the entire area enclosed by the guide surfaces 106 and the opposed press roll 102.

In addition, at some points throughout the pulp passage, specifically at the zones where wash liquid is added or in the region of the pulp inlet 109, the distance between the outer guide surface 106 and the outer surface of the press roll 102 might differ from the generally increasing radial distance for the rest of the pulp passage. Preferably, the radial distance between the press roll 102 and the guide surface 106 in those areas is temporary larger or greater than the generally increasing radial distance, such that flow impeding bulges or similar are still avoided.

Typically, the distance may deviate about 1 to 5 mm from the radial distance D of the main portion of the pulp passage in connection to the wash liquid inlets. This is due to the fact that as a result of the addition of wash liquid there may be an expansion or swelling of the pulp suspension and, in order to minimize the risk of plugging in such areas, the pulp passage 108 could in those regions be somewhat wider. According to one embodiment of the present invention, the radial distance D is constant over more than 80% of the pulp passage, the vat may be designed to diverge over, or in the vicinity, of a point of addition of pulp liquid. In such an embodiment the radial distance could e.g. be set to diverge about 1 to 5 over a point of addition of pulp liquid, but remain at that same level during the remainder of the vat. The radial distance may be in the range of 10 to 200 mm, and preferably in the range of 20 to 60 mm, throughout the whole length of the vat. In one specific embodiment the radial distance D is about 30 mm at the inlet 109, and about 50 mm close to the pinch 110.

In another advantageous embodiment of the present invention the vat may be arranged to be slightly diverging throughout the whole length of the vat, as is shown in FIGS. 2 and 5. It may also be relatively constant for the first part of the vat and only diverge close to the pinch. A main object of the present invention is to avoid the effect that the vat converges such that the passage of the pulp is hindered. This object is generally fulfilled as long as the vat is not converging at any point. Another object is however not to worsen the dewatering of the pulp such that the pulp that exits the nip or pinch has been sufficiently dewatered. A strongly diverging vat may, which is obvious to the skilled person, compromise this object. However, a somewhat diverging, at parts or throughout the whole length of the vat, has no negative effect on the dewatering of the pulp, whereas it has a positive effect on reducing plugging in the pulp passage, and thereby in keeping the downtime of the apparatus at a minimum.

By avoiding the converging geometry, of course with the exception of the short portions described above where the radial distance first diverges and then converges back to the initial radial distance D, the pulp suspension is allowed to flow more freely and the pressure in the vat is created by a hydraulic pulse generated from the nip and backwards (in the direction against rotation of the press rolls). Also, wash liquid added to the wash press may contribute to the pressure profile.

In prior art the pulp suspension was forced towards the outer surface of the press roll, such that fibers may be forced through the perforations of the press rolls along with the filtrate. In the arrangement according to the invention, the pulp suspension may, one might say, decide how and where it is to be dewatered, whereby the contents of fibers in the filtrate is minimized, i.e. the dewatering is not forced upon the pulp suspension, but progresses at a pace that is natural to the properties of the pulp suspension. This is accomplished as the pulp suspension is no longer forced by the geometry of the vat towards the outer surface of the press roll. The dewatering of the pulp suspension in a washing arrangement according to the invention thus implies that the fibers in the pulp suspension will be less subject to fiber damages. However, the diverging geometry is also effective for guide surfaces of a much lesser winding angle, such as e.g. 160-200°, even though the advantages become more apparent at longer winding angles.

In order to obtain the desired pressure profile it is advantageous that the vat, except for the dewatering openings in the press roll, is defined in a substantially closed space. Thus, in addition to the dewatering perforations of the press roll, there should preferably be no holes in or the like in the guide surfaces 106, which defines the outer limit of the vat 107. This is especially important close to the nip, as the pressure that builds up in the nip will be lost if there are opening or other "escape routes" for the filtrate in that area. Such a lost of pressure would in turn imply that the pressure may not be sufficiently high to create a pressure gradient opposite the movement of the pulp towards the beginning of the vat, wherein an important aspect of the invention would be lost.

As mentioned above, an advantage of diverging the vat geometry is the fact that the larger open space between the press roll 102 and the vat 107 minimizes the tendency of plugging of pulp suspension. Since the pulp is allowed to flow more freely, it always has the option of flowing backwards, i.e. in a direction countercurrent to the main flow in the direction of rotation of the press rolls 102. A minimized plugging tendency leads to increased availability of the apparatus, since undesired stopping of the press operation is avoided. The diverging geometry makes it possible to employ a higher vat pressure in the vat.

The pulp inlet is in the figure illustrated as being placed in the region of the press roll's outermost point. However, it is equally possible to arrange the pulp inlet at any other point, such as in the region of the press roll's highest point, wherein the winding angle would be close to 270°. The pressure profile created by the aforementioned mechanisms is independent on the placement of the pulp inlet.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for washing and dewatering cellulose pulp comprising a first rotatable press roll for use in conjunction with a second rotatable press roll forming a pinch therebetween for dewatering said cellulose pulp, said first rotatable press roll including a first perforated outer surface for dewatering said cellulose pulp, a first inlet disposed adjacent to said first rotatable press roll for supplying said cellulose pulp to said first perforated outer surface, and a first stationary guide member circumferentially enclosing said first rotatable press roll from said first inlet to said pinch and forming a substantially closed vat thereby forming a first pulp passage having a predetermined radial dimension between said first perforated outer surface of said first rotatable press roll and said first stationary guide surface, whereby said cellulose pulp is transported through said first pulp passage as said first rotatable press roll rotates towards said pinch, said predetermined radial dimension increasing over the distance from said first inlet to said pinch whereby said substantially closed vat diverges from said first rotatable press roll, and said first stationary guide surface being substantially free of any perforations for the passage of liquid therethrough in the area of said pinch thereby maintaining the pressure in said area of said pinch.

2. The apparatus of claim 1 wherein said first stationary guide surface is substantially free of any perforations substantially over its entire surface from said first inlet to said pinch.

3. The apparatus of claim 1 including a second rotatable press roll juxtaposed with said first rotatable press roll thereby forming said pinch therebetween, said second rotatable press roll including a second perforated outer surface for dewatering said cellulose pulp, a second inlet disposed adjacent to said second rotatable press roll for supplying said cellulose pulp to said second perforated outer surface, and a second stationary guide member circumferentially enclosing said second rotatable press roll from said second inlet to said pinch forming a substantially closed vat thereby forming a second pulp passage having a predetermined radial dimension between said second perforated outer surface of said second rotatable press roll and said second stationary guide surface, whereby said cellulose pulp is transported through said second pulp passage as said second rotatable press roll rotates towards said pinch, said predetermined radial dimension increasing over the distance from said second inlet to said pinch, whereby said substantially closed vat diverges from said second rotatable press roll, and said second stationary guide surface being substantially free of any perforations for the passage of liquid therethrough in the area of said pinch thereby maintaining the pressure in said area of said pinch whereby a wedge volume is formed in the area of said pinch into which said cellulose pulp is fed from said first and second pulp passages before they merge and enter into said pinch.

4. The apparatus of claim 1 including at least one washing zone for adding liquid into said first pulp passage.

5. The apparatus of claim 1 wherein said predetermined radial dimension continues to increase over at least 80% of said first pulp passage.

6. The apparatus of claim 1 wherein said first stationary guide surface encloses said first press roll around at least about 160° of the circumference of said first press roll.

7. The apparatus of claim 1 wherein said first stationary guide surface encloses said first press roll around at least about 180° of the circumference of said first press roll.

8. The apparatus of claim 1 wherein said first stationary guide surface encloses said first press roll around at least about 225° of the circumference of said first press roll.

9. The apparatus of claim 1 wherein said first inlet is disposed proximate to the highest vertical point of said first press roll.

10. The apparatus of claim 1 wherein said predetermined radial dimension is from between 10 and 200 mm.

11. The apparatus of claim 10 wherein said predetermined radial dimension is from between 20 and 60 mm.

* * * * *

UNITED STATES PATENT AND TRADEMARK OFFICE

CERTIFICATE OF CORRECTION

PATENT NO. : 8,048,271 B2
APPLICATION NO. : 12/600926
DATED : November 1, 2011
INVENTOR(S) : Rickard Andersson It is certified that error appears in the above-identified patent and that said Letters Patent is hereby corrected as shown below:

Column 7, line 25, after “5” insert --mm--.

Signed and Sealed this
Twenty-fifth Day of December, 2012

David J. Kappos

David J. Kappos
*Director of the United States Patent and Trademark Office*